US008840380B2

(12) United States Patent
Shieh et al.

(10) Patent No.: US 8,840,380 B2
(45) Date of Patent: Sep. 23, 2014

(54) TEMPERATURE CONTROL RING FOR VEHICLE AIR PUMP

(75) Inventors: Tenghua Tom Shieh, Ann Arbor, MI (US); Kyle Thomas Bernier, Clarkston, MI (US); James Guitar, Marysville, OH (US); Shohei Nomura, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 13/010,892

(22) Filed: Jan. 21, 2011

(65) Prior Publication Data

US 2012/0189436 A1 Jul. 26, 2012

(51) Int. Cl.
*F04D 29/58* (2006.01)
*F04D 23/00* (2006.01)

(52) U.S. Cl.
CPC ..... *F04D 23/008* (2013.01); *F04D 29/584* (2013.01)
USPC ..... 417/368; 417/367; 417/366; 417/423.8

(58) Field of Classification Search
CPC ..... F04D 29/584
USPC ..... 417/368, 366, 367, 423.8; 310/58
See application file for complete search history.

(56) References Cited

U.S. PATENT DOCUMENTS

| | | | | |
|---|---|---|---|---|
| 1,443,006 | A * | 1/1923 | Church | 123/196 AB |
| 1,634,304 | A * | 7/1927 | Schleyer | 415/204 |
| 1,810,297 | A * | 6/1931 | Schleyer | 417/409 |
| 2,784,672 | A | 6/1957 | Wallace | |
| 2,942,555 | A * | 6/1960 | Pezzillo | 417/372 |
| 4,715,327 | A | 12/1987 | Eberhardt | |
| 4,873,833 | A * | 10/1989 | Pfeiffer et al. | 62/55.5 |
| 4,890,988 | A * | 1/1990 | Kramer et al. | 417/372 |
| 5,250,863 | A | 10/1993 | Brandt | |
| 5,332,369 | A | 7/1994 | Jensen | |
| 5,548,964 | A * | 8/1996 | Jinbo et al. | 62/55.5 |
| 5,616,973 | A | 4/1997 | Khazanov et al. | |
| 6,032,466 | A * | 3/2000 | Woollenweber et al. | 60/607 |
| 6,121,698 | A | 9/2000 | Sexton | |
| 6,599,108 | B2 * | 7/2003 | Yamashita | 417/423.4 |
| 6,668,765 | B2 | 12/2003 | Zlotek | |
| 6,793,466 | B2 * | 9/2004 | Miyamoto | 417/313 |
| 7,165,933 | B2 | 1/2007 | Gerstenberg | |
| 7,530,230 | B2 * | 5/2009 | Shibui et al. | 60/608 |
| 7,737,584 | B2 * | 6/2010 | Muller et al. | 310/52 |
| 7,750,529 | B2 * | 7/2010 | Tajima et al. | 310/257 |
| 7,800,259 | B2 * | 9/2010 | Elgas et al. | 310/52 |
| 7,802,614 | B2 * | 9/2010 | Elnar | 165/46 |

FOREIGN PATENT DOCUMENTS

| | | | |
|---|---|---|---|
| EP | 0395234 | A1 | 10/1990 |
| EP | 0451708 | A2 | 10/1991 |
| EP | 0943810 | A1 | 9/1999 |
| EP | 1361368 | A2 | 11/2003 |
| JP | 07266857 | A | 10/1995 |

* cited by examiner

*Primary Examiner* — Devon Kramer
*Assistant Examiner* — Christopher Bobish
(74) *Attorney, Agent, or Firm* — Gifford, Krass, Sprinkle, Anderson & Citkowski, P.C.

(57) ABSTRACT

An annular device for the temperature control of a pump is provided. That device is in fluid communication with the radiator coolant system of a vehicle, and the engine-warmed coolant flows through the annular device to warm the pump and thaw ice buildup. The device is removable and can be added on to an existing pump without any redesign of the existing pump housing.

9 Claims, 3 Drawing Sheets

TEMPERATURE CONTROL RING FOR VEHICLE AIR PUMP

FIELD OF THE INVENTION

The invention relates to temperature control in air pumps for automobiles. More specifically, the invention relates to an annular device for heating surfaces within the air pump having a tendency to accumulate fluid which may freeze in cooler climates.

BACKGROUND OF THE INVENTION

The need to control the temperature of a pump has long been known in the art, and has traditionally been solved by the addition of a cooling jacket around the pump. Cooling jackets come in a variety of designs, but most consist of a channel within the pump housing that completely encircles the motor in all directions. Such cooling jackets may circulate a portion of the fluid being pumped or a separate cooling fluid around the pump to maintain the pump's optimum operating temperature.

Cooling jackets are bulky and expensive and it can be difficult if not impossible to retrofit an existing pump housing with a cooling jacket if it was not included in the original design.

Certain air pump housings have a tendency to accumulate water vapor which then pools in concave portions within the housing and may freeze in cooler climates. If too much water accumulates and freezes it can impair the movement of pump parts, particularly the impeller. When the movement of the impeller is impaired the check engine light will be activated or it may result in burnout of the motor. Most cooling jackets are designed to facilitate the cooling of the pump and are located where the pump is more likely to overheat. Few, if any, cooling jackets are appropriately structured to also provide for the warming of key elements of the pump to encourage freedom of movement of the parts and quickly bring the pump to an optimum operating temperature.

The present invention overcomes these obstacles and provides for a temperature control device for an air pump that is inexpensive, small, easily fitted to an existing pump without reengineering the pump housing, and appropriately designed to heat key elements within the pump to quickly bring the pump to the optimum operating temperature.

SUMMARY OF THE INVENTION

The present invention relates to a temperature control device for use with an air pump.

One object of the current invention is to rapidly thaw the ice dams that form within the pump housing to allow freedom of movement to all parts of the pump, but particularly the impeller. This rapid thawing and resulting freedom of movement will diminish the risk of motor burnout.

The temperature control ring can be added to the pump housing adjacent to portions of the pump housing where fluid has a tendency to accumulate and freeze. The temperature control ring is preferably in fluid communication with the vehicle coolant system so that coolant that has been heated by the engine then passes through the ring warming the portions of the pump housing with which it comes into contact. The coolant exits the ring and rejoins the standard flow of coolant entering the vehicle radiator.

Because the ring is in contact with the portion of the housing being heated, there is no need for it to be as bulky and intrusive as a cooling jacket. The ring is also small enough that it can fit between parts of the existing pump housing which eliminates the need to completely reengineer the housing to accommodate a cooling jacket.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Figure 1:
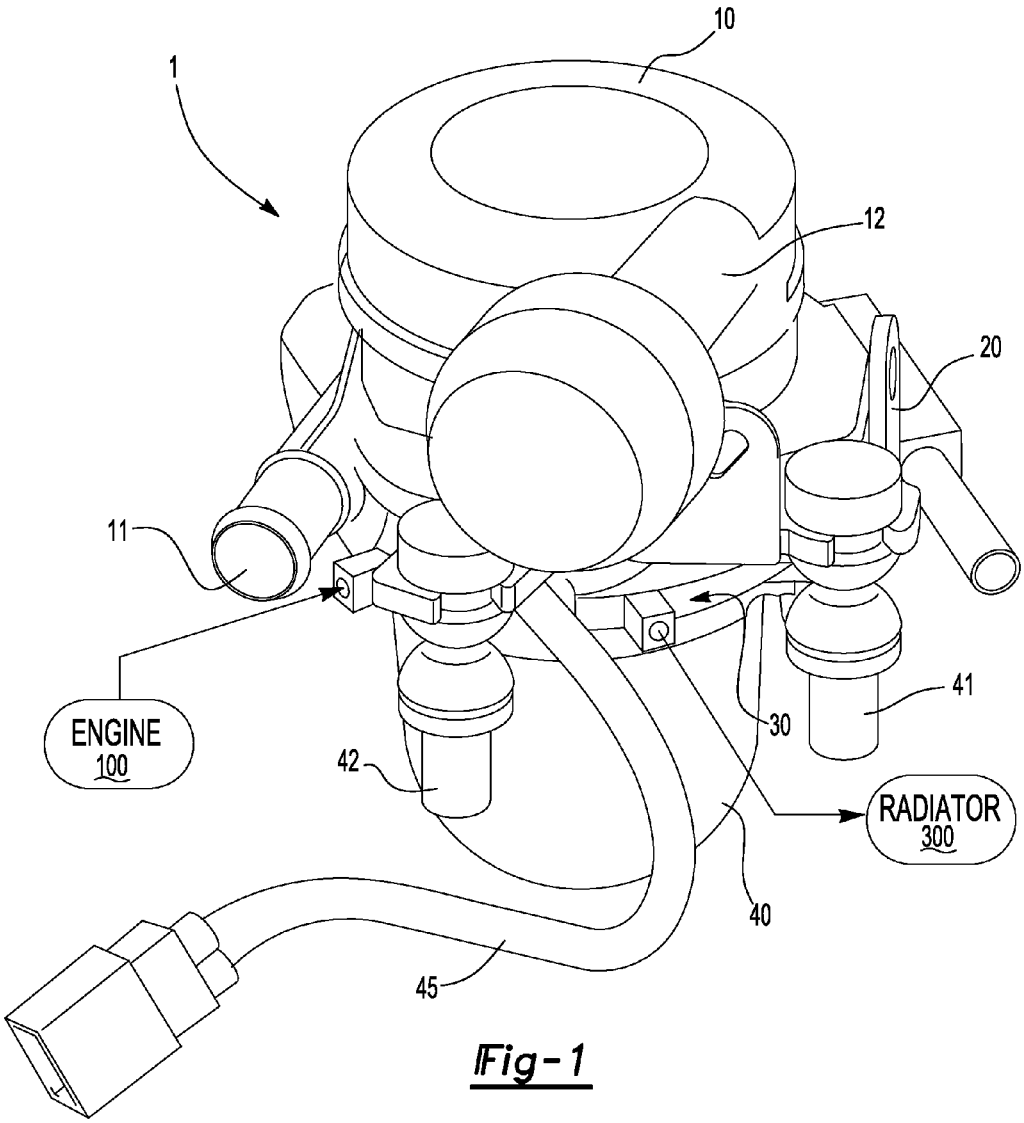
FIG. 1 is a perspective view of the pump housing including the ring and a summary of the flow of coolant through the vehicle.
Figure 2:
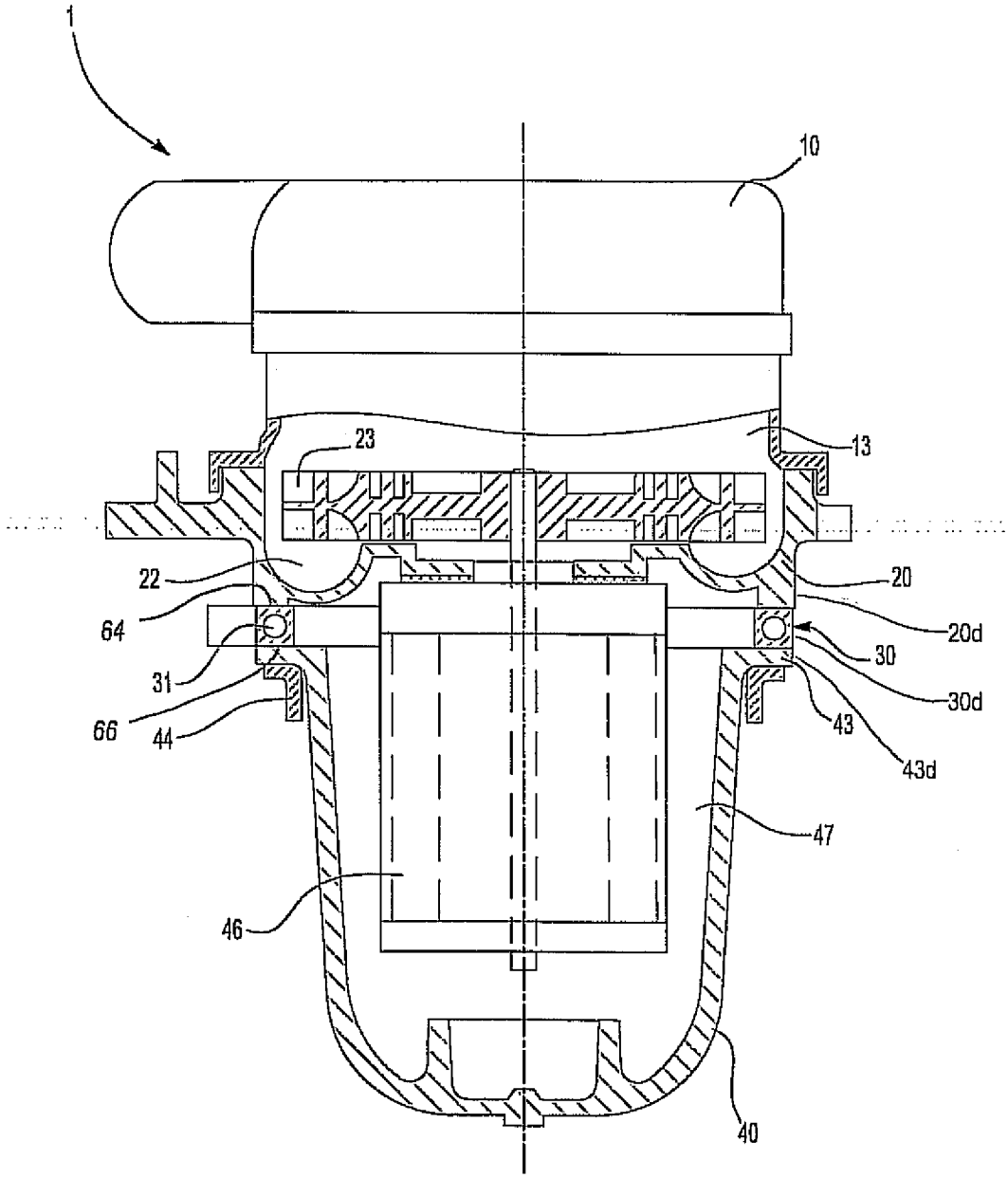
FIG. 2 is a cross sectional view of the pump housing.
Figure 3:
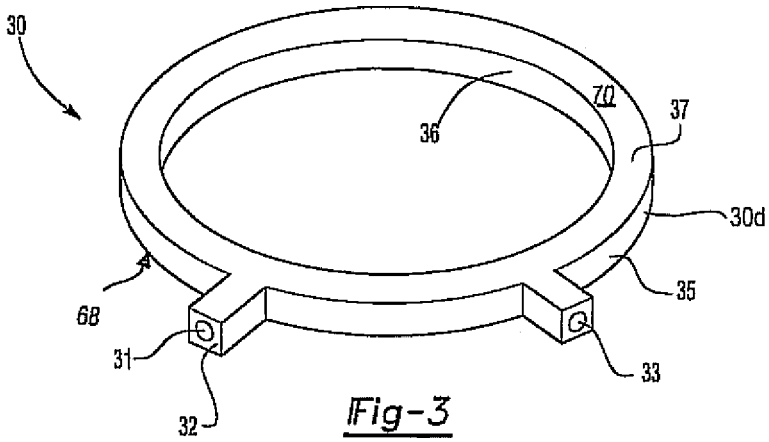
FIG. 3 is a perspective view of one embodiment of the proposed invention.
Figure 4:
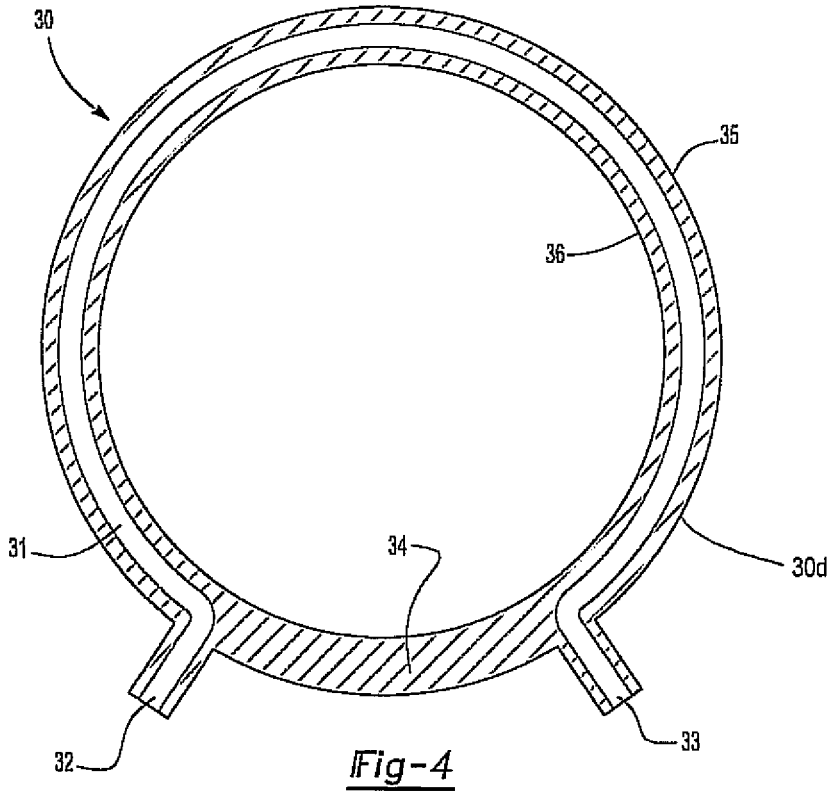
FIG. 4 is a cross sectional view of the embodiment depicted in FIG. 3.

This temperature control ring is designed to be added to an existing pump housing to facilitate the warming of key parts within the housing without the need for a complete cooling jacket.

The air pump housing 1 consists of a housing top 10, a horizontally extending wall 20, the inventive ring 30, and a housing bottom 40. The housing top 10 defining a pumping chamber 13 and has an air inlet 11 and an air outlet 12. The housing bottom 40 defines a cavity 47 and has an annular lip 43 which is held in place by mounting pins 41 and 42 between the horizontally extending wall 20 and a holding piece 44. The housing top 10 further includes an annular wall 64. The housing bottom 40 further includes an upper surface 66. The horizontally extending wall 20 also has a notch (not shown) to accommodate the electrical lines 45.

The horizontally extending wall 20 has a concave channel 22 that extends around the circumference of the pump housing 1 in which moisture has a tendency to accumulate. This moisture may freeze in cold temperatures. An impeller 23 is located above the channel 22, the impeller 23 may be frozen in place in such conditions when the channel 22 fills with ice. The ring 30 is directly beneath the horizontally extending wall 20 and with a radial wall 37 in contact with the channel 22 in which the ice accumulates. An outer diameter of the horizontally extending wall 20*d* is substantially similar to the outer diameter of the ring 30*d*.

Radiator coolant from the vehicle coolant system flows from the engine 100 where it is warmed into the ring 30 through the inlet 32. The engine-warmed coolant flows through the inner passage 31 in the ring 30 which follows substantially the same curvature as the channel 22. The flow of the coolant warms the channel 22 and melts the ice, which then allows the impeller 23 to rotate freely. The engine-warmed coolant then flows out of the inner passage 31 through the outlet 33 and returns to the existing vehicle radiator 300. The ring 30 further includes an upper surface 70 and a lower surface 68. The upper surface 70 abutting the annular wall 64 of the housing top 10. The lower surface 68 abutting the upper surface 66 of the housing bottom 40.

The inner passage 31 within the ring 30 follows the channel 22 in the horizontally extending wall 20 above it around the circumference of the pump housing 1. The channel 22 does not extend around the entire circumference of the pump housing 1 due to the notch to accommodate the electrical lines 45 therefore the inner passage 31 need not extend around the full circumference of the pump housing 1. A solid portion 34 exists in the ring 30 that sits under the portion of the horizontally extending wall 20 that accommodates the electrical lines 45. The inner circumferential wall 36 of the ring 30 encircles the motor 46 and the outer circumferential wall 35 of the ring 30 forms part of the outer surface of the pump housing 1.

In an alternative embodiment, the inner passage 31 extends around the entire circumference of the pump 46, and the fluid inlet 32 and fluid outlet 33 are located directly next to each other. Alternatively, the inner passage 31 makes multiple loops within the ring 30.

In the figures the cross section of the ring 30 is pictured such that the exterior is a rectangular shape and the hollow interior passage 31 is circular, however the precise cross section is unimportant and could be any shape desired. Similarly, the inlet 32 and outlet 33 are any shape that allows for the ring 30 to be coupled to the appropriate fluid source.

As such, the invention is not restricted to the illustrative examples or embodiments described above. The examples or embodiments are not intended as limitations on the scope of the invention. Processes, apparatus, compositions, and the like described herein are exemplary and not intended as limitations on the scope of the invention. Changes herein and other uses will occur to those skilled in the art. The scope of the invention is defined by the scope of the claims.

We claim:

1. A device for the temperature control of an air pump, the pump having a housing top and a housing bottom, the housing top defining a pumping chamber having an impeller, the device in fluid communication with a supply of liquid heated by an engine, the housing bottom having an annular lip which defines an outer diameter of the annular lip, the device comprising:

a ring having a top surface, a bottom surface, a fluid inlet, a fluid outlet, and an inner passage, the fluid inlet and the fluid outlet spaced apart being coplanar with and defined by the inner passage top surface and bottom surface, the inner passage extending between the fluid inlet and the fluid outlet, the ring defines an outer diameter of the ring, the outer diameter of the annular lip is substantially similar to the outer diameter of the ring;

an annular wall disposed on the housing top;

an upper surface disposed on the housing bottom, the annular wall of the housing top spaced apart from the upper surface of the housing bottom, the upper surface of the housing bottom abutting the bottom surface of the ring, the annular wall of the housing top abutting the top surface of the ring;

the fluid inlet, the fluid outlet, and inner passage being in fluid communication with the liquid heated by the engine;

wherein the top surface of the ring transfers heat energy to and from the housing top and the bottom surface of the ring can transfer heat energy to and from the housing bottom when the ring is disposed between, and in mechanical communication with, the housing top and the housing bottom to prevent ice dams from forming in the pump.

2. The device of claim 1, wherein the ring further comprises an outer circumferential wall forming a portion of a housing.

3. The device of claim 1, wherein a horizontally extending wall has a channel for conveying fluid moved by the impeller.

4. The device of claim 3, wherein a radial wall of the ring is adjacent the channel.

5. The device of claim 1, wherein the liquid is engine coolant.

6. The device of claim 1, wherein the ring further comprises an inner circumferential wall defining a cavity.

7. The device of claim 6, wherein the pump has a motor which is received in the cavity formed by the inner surface of the cooling member.

8. The device as described in claim 1 further comprising a fluid line removably coupled to said inlet through which a fluid flows having been warmed by the engine and a fluid line removably coupled to said outlet through which said fluid flows to a vehicle radiator.

9. The device of claim 1 wherein the housing top has a horizontally extending wall, the horizontally extending wall defines an outer diameter of the horizontally extending wall, the outer diameter of the horizontally extending wall is substantially similar to the outer diameter of the ring.

* * * * *